US006261164B1

(12) United States Patent
Rivard et al.

(10) Patent No.: US 6,261,164 B1
(45) Date of Patent: Jul. 17, 2001

(54) MULTIPLE ABRASIVE ASSEMBLY AND METHOD

(75) Inventors: Allen J. Rivard, White Bear Lake; Galen A. Fitzel, St. Paul; Chris A. Minick, Stillwater, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/650,442

(22) Filed: Aug. 29, 2000

Related U.S. Application Data

(60) Division of application No. 08/937,206, filed on Sep. 17, 1997, which is a continuation-in-part of application No. 08/744,259, filed on Nov. 6, 1996, now abandoned.

(51) Int. Cl.[7] ..... A47L 11/40

(52) U.S. Cl. ..... 451/359; 451/353; 451/496; 451/538

(58) Field of Search ..... 451/350, 353, 451/359, 496, 538, 539, 532, 530

(56) References Cited

U.S. PATENT DOCUMENTS

| | | |
|---|---|---|
| 2,823,516 | 2/1958 | Christian . |
| 2,958,593 | 1/1960 | Hoover et al. . |
| 3,527,001 | 9/1970 | Kleemeier et al. . |
| 3,698,032 | 10/1972 | Young . |

(List continued on next page.)

FOREIGN PATENT DOCUMENTS

| | | |
|---|---|---|
| 25 02 902 | 6/1976 | (DE) . |
| 30 37 931 | 4/1982 | (DE) . |
| 31 08 023 | 9/1982 | (DE) . |
| 91 05 607 U | 11/1991 | (DE) . |
| 43 39 110 | 5/1995 | (DE) . |
| 0 112 405 | 7/1984 | (EP) . |
| 1191459 | 5/1970 | (GB) . |
| 2 247 201 | 2/1992 | (GB) . |
| WO 93/08955 | 5/1993 | (WO) . |
| WO 95/13164 | 5/1995 | (WO) . |
| WO 95/19242 | 7/1995 | (WO) . |

OTHER PUBLICATIONS

Patent Abstracts of Japan, Vol. 6, No. 69 (M–125) Apr. 30, 1982 and JP 57 008082 A, Jan. 16, 1982.

Technical Service Bulletin No. 87 entitled *3M Brand Stikit™ Floor Surfacing Abrasive Sheets for Square–Buff and Other Orbital Sanding Equipment,* 3M Construction Markets, dated Oct. 25, 1991.

Clarke® American Sanders, Part No. 78871 A (published prior to Nov. 6, 1996).

Varathane® Brand Floor Finishing System, *Five Easy Steps of Floor Finishing,* by the Flecto Company, Inc., pp. 1–9 (published prior to Nov. 6, 1996.

CPS GREEN STRIP® *Conditioning Pad System Sandpaper Strip,* by Bonakemi USA, Inc., Item ADV CPSGREEN300 20M, dated Jun., 1996.

*Primary Examiner*—Elieen P. Morgan
(74) *Attorney, Agent, or Firm*—James J. Trussell

(57) ABSTRACT

An abrasive article is formed from a lofty nonwoven abrasive pad and one or more abrasive sheets. In one embodiment, each sheet has an abrasive layer on its front side and a plurality of engagement stems on its back side. Enough of the engagement stems engage fibers on the surface of the nonwoven pad to affix the two components together for workpiece surface treatment. In another embodiment, the nonwoven pad has a slit therein, and each abrasive sheet has a portion thereof inserted into its respective slit to anchor the sheet to the pad. In this embodiment, each sheet has an abrasive layer on its front side but may have no stems on its back side. In either embodiment, the sheets are readily replaceable on the nonwoven pad, thus creating a very simple and versatile arrangement for varying the abrasive characteristics presented to the workpiece.

11 Claims, 5 Drawing Sheets

U.S. PATENT DOCUMENTS

| | | | | |
|---|---|---|---|---|
| 3,703,739 | * | 11/1972 | Young et al. | 451/538 |
| 3,708,833 | | 1/1973 | Ribich et al. . | |
| 3,823,516 | | 6/1974 | Christian . | |
| 4,263,755 | | 4/1981 | Globus . | |
| 4,275,529 | | 6/1981 | Teetzel et al. . | |
| 4,437,271 | | 3/1984 | Mcavoy . | |
| 4,541,207 | | 9/1985 | Antonson . | |
| 4,609,380 | | 9/1986 | Barnett et al. . | |
| 4,708,204 | * | 11/1987 | Eisenblatter | 451/496 |
| 4,747,176 | * | 5/1988 | Parks | 451/353 |
| 5,082,720 | | 1/1992 | Hayes . | |
| 5,170,595 | | 12/1992 | Wiand . | |
| 5,174,795 | | 12/1992 | Wiand . | |
| 5,389,032 | | 2/1995 | Beardsley . | |
| 5,454,751 | * | 10/1995 | Wiand | 451/353 |
| 5,505,747 | | 4/1996 | Chesley et al. . | |
| 5,507,061 | * | 4/1996 | Miyazaki | 451/353 |
| 5,609,516 | | 3/1997 | Courson et al. . | |
| 5,725,423 | | 3/1998 | Barry et al. . | |

* cited by examiner

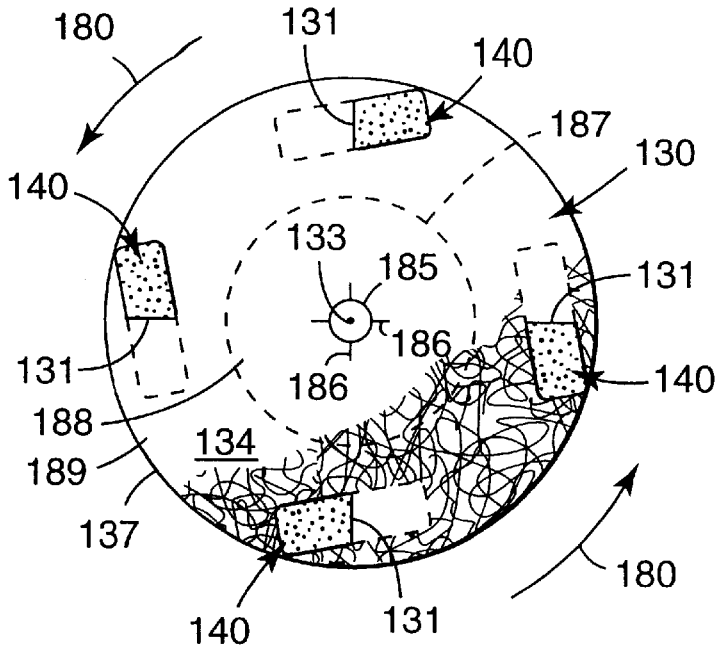
Fig. 5
Fig. 6
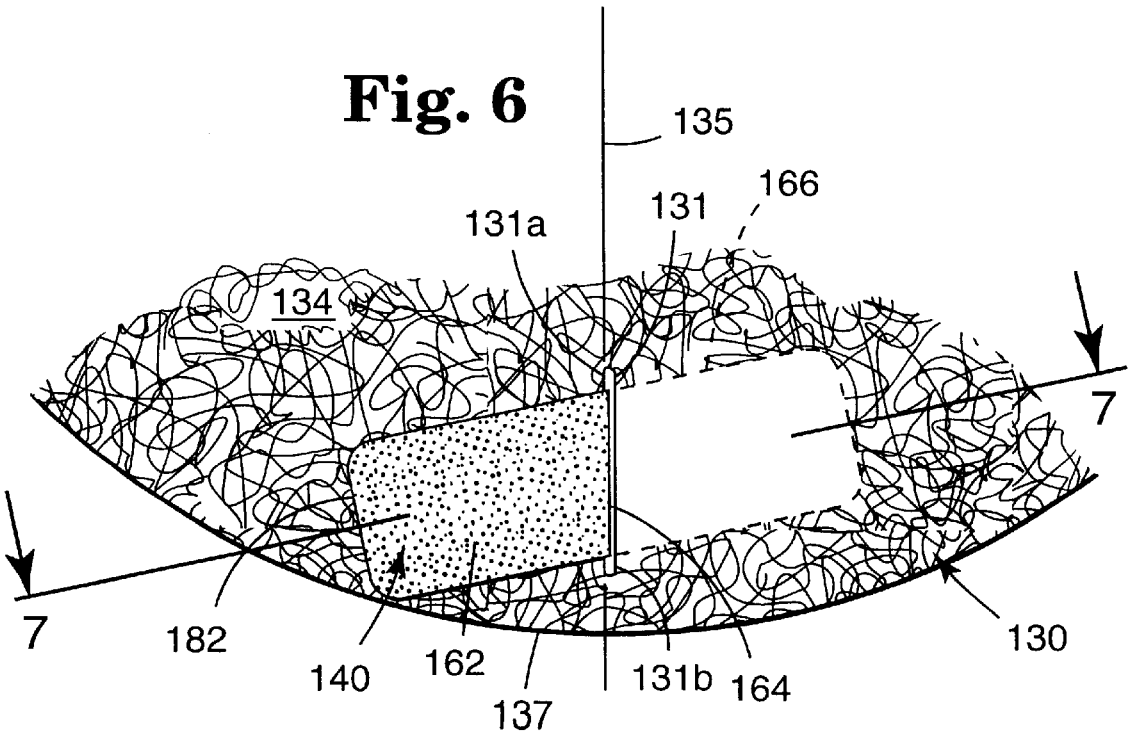

MULTIPLE ABRASIVE ASSEMBLY AND METHOD

This is a division of application Ser. No. 08/937,206, filed Sep. 17, 1997 pending which is a continuation-in-part of application Ser. No. 08/744,259, filed Nov. 6, 1996 now abandoned. Priority of the prior application is claimed pursuant to 35 U.S.C. §120.

BACKGROUND OF THE INVENTION

The invention relates to surface treatment assemblies. More specifically, the invention relates to an abrasive assembly which presents a workpiece to be surface treated with at least two separate abrading surfaces, with each abrading surface having different abrasive characteristics, to a method for making such an abrasive assembly, and to its use.

Surface finishing of a workpiece can include sanding, buffing, polishing or other finishing processes. A wide variety of materials for such finishing have been used. For example, sandpaper of various grades and nonwoven finishing pads with abrasive coatings or additives are well known. One manufacturer of sandpaper products is Minnesota Mining and Manufacturing Company, St. Paul, Minn. Sandpaper sheets in various configurations and abrasive grades, double-sided abrasive sheets ("duplex" sheets), as well as abrasive sheet material where one side has abrasive and the other side has pressure sensitive adhesive, are all well known. Nonwoven pads having a variety of surface treatment characteristics (and in varying abrasive grades) are also available from Minnesota Mining and Manufacturing Company, St. Paul, Minn., commercially referred to as SCOTCH-BRITE™ pads.

Although these surface finishing materials can be used to refine nearly any surface, they have found particular application to floor refinishing techniques. It is common in floor sanding to use a nonwoven abrasive pad on a rotary sander machine as a cushion between the sander and a sandpaper sheet facing the floor. An abrasive disk of sandpaper of the same size or larger than the circular face of the nonwoven pad is either mechanically fastened from its center to the sander, or mounted relative to the nonwoven pad via use of a double-sided abrasive disk or affixed by a pressure sensitive adhesive on the back of the disk to adhere the disk to the nonwoven pad. Mechanical fastening of a sanding disk from its center requires the use of a full abrasive disk, which reduces unit pressure for sanding, limits the ability of the sandpaper to conform to the floor surface, and wastes the abrasive in the center of the disk. Double-sided abrasive disks rely on a loose mechanical bite between the back abrasive side and the nonwoven disk to maintain those components attached for coupled rotation. The use of a pressure sensitive adhesive to mount the sandpaper to the nonwoven pad allows the placement of a disk over the face of a pad. However, the pressure sensitive adhesive may not hold well to the non-uniform fibrous face of the nonwoven pad, especially if the pad has any dust or debris built up on it, which is very common in finishing operations (e.g., sanding of drywall, cabinets, furniture, automobiles and similar operations that generate fine sanding dust) and in the hostile workplace environment in which such operations often take place. Increasing the density of the nonwoven pad provides additional fiber surfaces for pressure sensitive adhesive bonding, but may not be desired for other functional reasons.

For some floor finishing situations, a strip of sandpaper is mounted across the face of an abrasive nonwoven disk to present two different abrasive surfaces to the floor for surface treatment. The sandpaper strip is secured in place relative to the nonwoven pad either by folding the sandpaper over so the abrasive is on both sides of the sandpaper sheet, or by just folding over the edges of the sandpaper sheet, or by using a pressure sensitive adhesive disposed on the back of the sandpaper sheet. None of these attachment alternatives has resulted in a connection between the sandpaper and the nonwoven web which is sufficiently simple, reliable and repeatable in the dusty, non-uniform and hostile (and rapidly rotating) floor sanding environment.

As a floor surface is treated, it may be necessary to substitute a fresh sheet of sandpaper, or it may be desired to change to a sandpaper sheet having a different abrasive grade. After initial use, this may not be possible using a pressure sensitive adhesive backed sandpaper on a nonwoven pad because the dust on the pad prevents a second sandpaper sheet from adhering to the pad. Thus, not only is a different sheet of sandpaper required for further finishing, but a clean nonwoven pad is also required, in order to adhere the sandpaper to the nonwoven pad. The existing (dirty) nonwoven pad must be cleaned or a new nonwoven pad used. This is especially troublesome for applications where it is desired to arrange a sheet of sandpaper on the face of a nonwoven pad which is smaller than the nonwoven pad, so that the abrading surface presented to the floor includes not only the sandpaper but also the abrasive on the nonwoven pad itself. Prior to the present invention, there has been no truly effective means for affirmatively securing a sandpaper sheet across a portion of a nonwoven abrasive pad for use in creating an abrasive assembly which presents multiple abrasive surfaces for workpiece surface treatment.

SUMMARY OF THE INVENTION

The present invention includes an abrasive assembly which presents at least two separate abrading surfaces to a workpiece for surface treatment thereof, with the two surfaces having different abrasive characteristics. The abrasive assembly comprises a nonwoven pad having a major generally planar face defining a first one of the abrading surfaces, and a sheet, smaller than the planar face of the nonwoven pad, having front and back major sides. The front side of the sheet defines a second one of the abrading surfaces and the back side of the sheet has a plurality of hooking stems projecting therefrom releasably engaged with the face of the nonwoven pad.

The present invention also includes a method of assembling an abrasive assembly. A nonwoven pad having a major generally planar face is provided, with the face having abrasive characteristics and defining an engaging surface. A sheet smaller than the planar face of the nonwoven pad is also provided, with the sheet having front and back major surfaces. The front surface of the sheet has abrasive characteristics differing from those of the face of the nonwoven pad and the back surface of the sheet includes a plurality of hooking stems projecting therefrom. The method further includes the step of pressing the hooking stems on the back surface of the sheet against the engaging surface on the planar face of the nonwoven pad to releasably secure the sheet to the nonwoven pad.

The present invention further includes a method of surface treatment for a workpiece surface. The method includes providing a circular nonwoven pad having a major generally planar face, wherein the face has first abrasive characteristics and defines an engaging surface. A sheet smaller than the planar face of the nonwoven pad is provided, and has front and back major surfaces. The front surface of the sheet has second abrasive characteristics differing from those of the face of the nonwoven pad, and the back surface of the sheet includes a plurality of hooking stems projecting therefrom. The hooking stems on the back surface of the sheet are pressed against the engaging surface on the planar face of the nonwoven pad to releasably secure the sheet to the nonwoven pad. The face of the nonwoven pad and front surface of the sheet adhered thereto are placed against the workpiece surface, and the nonwoven pad is moved relative to the workpiece surface to present the abrasive characteristics of the front surface of the sheet and those portions of the nonwoven pad not covered by the sheet to the workpiece surface.

In an alternative embodiment, the inventive abrasive article for surface treatment of a workpiece comprises a nonwoven pad having front and back generally planar major faces, with the pad having a slit therethrough from one face to the other face. The abrasive article further includes a sheet having front and major back sides, with the front side of the sheet defining a desired abrasive surface. The sheet has a first portion thereof extending into the slit in the nonwoven pad and a second operable portion thereof lying with its back side against the front face of the nonwoven pad, and with the second operable portion being smaller than the front face of the nonwoven pad. Preferably, the nonwoven pad has a plurality of said slits, and the abrasive article further comprises a plurality of said sheets, with the first portion of each sheet extending into a respective one of the slits in the nonwoven pad and the second operable portion of each sheet lying with its back side against the front face of the nonwoven pad.

BRIEF DESCRIPTION OF THE DRAWINGS

The present invention will be further explained with reference to the drawing figures listed below wherein like structure is referred to by like numerals through the several views.

FIG. 5 is a ninth alternative embodiment of the present invention.

FIG. 6 is an enlarged view of a portion of the abrasive assembly of FIG. 5.

While the above-identified drawings features set forth several preferred embodiments, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
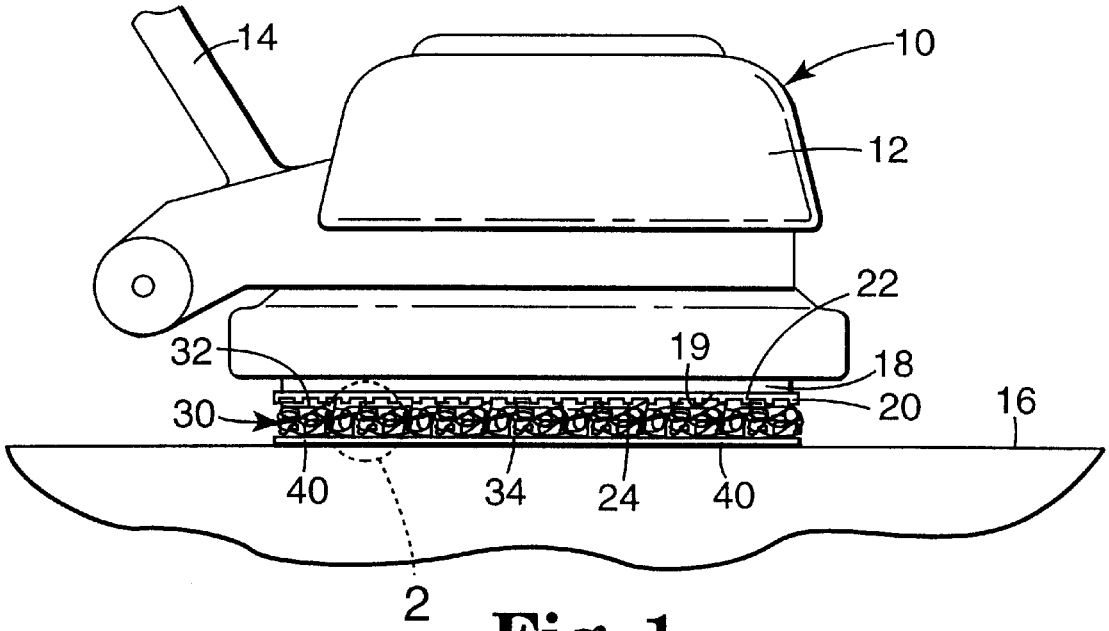
FIG. 1 is a side elevational view of a rotary floor sander having an abrasive assembly of the present invention mounted thereon.

A typical rotary floor sander machine 10 is illustrated in FIG. 1. The sander 10 has a main sander housing 12 connected to a handle 14, which is manipulated by an operator to advance the sander 10 across the floor surface 16 to be worked. While referred to herein as a "sander," the floor sander 10 can be used for other floor treatment operations such as buffing, polishing, etc., by varying the abrasiveness of the surface treatment material on the bottom of the sander 10. In the present inventive assembly, at least two materials having different "abrasive characteristics" are presented to a workpiece at the same time. The abrasive characteristics for any particular type of material (e.g., sandpaper) may differ significantly in "grade" (e.g., from a very coarse grade, highly abrasive state (for stock removal) to a very fine grade, almost nonabrasive state (for polishing or buffing work)).

The housing 12 of the sander 10 includes a drive motor (not shown) which is activated by the operator to rotate a drive platen 18 at the base of the sander 10. A bottom face 19 of the drive platen 18 is typically covered with a frictional material, such as rubber belting or sheet 20, which preferably has an array of protrusions or knobs 22 on a bottom side 24 thereof. The rubber sheet 20 and its protrusions 22 aid in engaging whatever floor surface treatment material or intermediate pads are positioned between the drive platen 18 and the floor surface 16.

Figure 2:
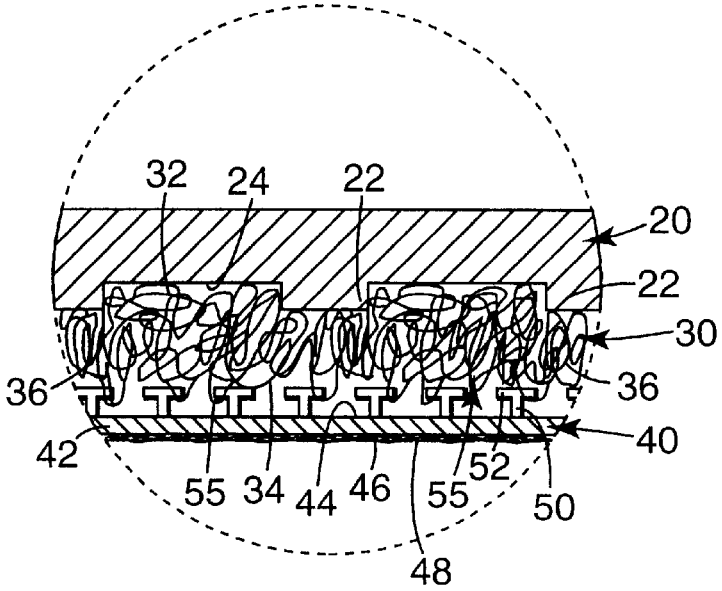
FIG. 2 is an enlarged section view as taken at view A in FIG. 1.

As illustrated in FIG. 1, a disk-shaped nonwoven pad 30 is aligned between the rubber sheet 20 and floor surface 16. The nonwoven pad 30 has a generally planar top surface 32 facing the bottom surface 24 of the rubber sheet 20, and a bottom surface 34, which is aligned with the floor surface 16. The nonwoven pad 30 is defined by a plurality of intermingled fiber segments 36 (FIG. 2) that are bonded together at fiber junctures to form a lofty matrix which is treated (e.g., coated) with an abrasive coating comprising adhesive and abrasive particles. One or more abrasive faced sheets 40 are disposed between the nonwoven pad 30 and the floor surface 16. FIG. 2 shows in more detail the interface between the nonwoven abrasive pad 30 with respect to the rubber sheet 20 and sheet of abrasive material 40.

As seen in FIG. 2, each abrasive sheet 40 is formed from a generally planar substrate 42 having a back connecting side 44 and a front working side 46. On its front side 46, the sheet 40 has a layer or coating of abrasive material 48 thereon. On its back side 44, the sheet 40 has means for mechanically engaging with the fibers 36 of the nonwoven pad 30 for fixing the sheet 40 relative to the nonwoven pad 30. Preferably, the engaging means is a plurality of engagement stems 50 projecting outwardly from the back side 44 of the sheet 40, with each stem 50 having an enlarged head 52 adjacent its outermost end. The engagement between the nonwoven pad 30 and abrasive sheet 40 is in the nature of a hook and loop fastener, with certain fibers 36 on the bottom surface 34 of the nonwoven pad 30 being engaged by certain stems 50 on the back side 44 of the abrasive sheet 40 (as at 55 in FIG. 2).

Nonwoven pads suitable for surface treatment include those commercially available in various formats (circular disks, sheets or rolls) from Minnesota Mining and Manufacturing Company, St. Paul, Minn., and are referred to as SCOTCH-BRITE™ pads. For floor treatment applications, preferable pads include "SCOTCH-BRITE™ Clean and Finish Discs," type A and type T. The lofty nonwoven pad 30 provides not only a cushioning layer between the abrasive sheet 40 and sander 10, but also itself has abrasive characteristics so that any exposed portions thereof are useful in treating the floor surface 16. Examples of lofty, nonwoven abrasive pads formed from crimped staple fibers are taught in Hoover et al. U.S. Pat. No. 2,958,593; Barnett et al. U.S. Pat. No. 4,609,380; and Hayes U.S. Pat. No. 5,082,720 (which are all incorporated by reference herein).

The abrasive sheet 40 may have a variety of shapes (as illustrated in FIGS. 3A–3F and 4A–4B), but in all respects it is smaller in size than the bottom surface 34 of the nonwoven pad 30. The abrasive material 48 on the front working side 46 of the sheet 40 may be any suitable, low profile abrasive, having different abrading characteristics from the nonwoven pad 30. The abrasive aggressiveness (or grade) of the abrasive material 48 can be as high or low as desired for a particular surface treatment application. Typically, the abrasive sheet is a coated abrasive article, also known as sandpaper. Coated abrasive articles can have a wide variety of properties, depending on what is desired. The backing of the article is generally a paper, film, or cloth, but can also be a reinforced thermoplastic backing such as taught by Stout et al. U.S. Pat. No. 5,316,812. The abrasive particles can include any abrasive or polishing particle, for example, aluminum oxide (including fused and ceramic, i.e., "sol gel"), alumina-zirconia, silicon carbide, garnet, diamond, CBN, mullite, ceria, crushed glass, plastic particles, and other polishing materials. The abrasive particles are typically held onto the backing by a resinous adhesive, often by a phenolic or epoxy or hide glue. The adhesive can be thermal or radiation cured. Another abrasive material suitable for use on the working side 46 of the sheet 40 is a structured abrasive article, available under the trade designation "Trizact" 307EA and 407EA structured abrasive article, from Minnesota Mining and Manufacturing Company, St. Paul, Minn. Further details regarding such structured abrasive articles are taught in Pieper et al. U.S. Pat. No. 5,152,917 (which is incorporated by reference herein).

The engaging means on the back connecting side 44 of the sheet 40 is also relatively low profile, and preferably is formed from hook stem materials such as those disclosed in Melbye et al. U.S. Pat. No. 5,077,870; Chesley U.S. Pat. No. 5,505,747; and in pending U.S. patent application Ser. Nos. 08/181,142 and 08/181,195 (both filed Jan. 14, 1994), which are all incorporated by reference herein. The hook stem material can be laminated to the abrasive article on the side opposite the working side, or the hook stems can be formed directly onto the side opposite the working side. Alternately, the abrasive coating (i.e., abrasive particles and adhesive) can be directly coated onto a substrate having the hook stems so that an integral sheet is formed.

As used herein, hook stem means a stem having a free end that is spaced from the surface to which the stem is attached and a structure (a head or J-shaped end) that enables the hook stem to releasably engage one or more fibers on an opposed engaging surface (the bottom surface 34 of the nonwoven pad 30). In FIG. 2, each stem 50 is illustrated as having a head 52 shaped in the form of a nail head. Alternative hook and stem head configurations will function to suitably engage the nonwoven pad 30. For instance, the head of a hook stem may have any suitable three-dimensional shape, such as a hemisphere, sphere, mushroom cap, cube, pyramid, etc. Preferably, the head has at least one undercut portion that extends radially away from the stem at a right angle, such as the heads 52 shown in FIG. 2, to hook the fibers or looped nonwoven filaments along the bottom surface 34 of the nonwoven pad 30. The hook stems and heads are sized and arranged to be sufficient to adhere the sheet 40 to the nonwoven pad 30, but allow for easy removal of the sheet 40 for replacement, or to allow use of the nonwoven pad 30 alone as a surface conditioning treatment material. Also, while the arrangement and formation of hook stems 50 are preferably generally uniform, alternative stem patterns, such as non-uniform stems and stem array arrangements will suffice. Preferably, the stem height ranges from approximately 0.002 to 0.102 inch (0.05 to 2.6 mm), and is more preferably about 0.020 inch (0.508 mm), and the stem density ranges from approximately 52 to 2000 stems per square inch (8 to 310 stems per square centimeter), and is more preferably about 400 stems per square inch (62 stems per square centimeter). Depending on stem density, nonwoven pad density and desired engagement characteristics, in some applications engagement stems having no heads will suffice to secure the abrasive sheet to the nonwoven pad.

Low profile stems are important, so that the sheet 40 can lay with its abrasive material 48 nearly coplanar with the bottom surface 34 of the nonwoven pad 30. The stems 52 need to be high enough to provide an engaging structure for the fibers of the nonwoven pad 30, but low enough so as not to add structural depth to the abrasive article assembly (and low enough not to extend through to the top surface 32 of the pad). It is intended that the back working side 46 of the sheet 40 lie as flush as possible with the bottom surface 34 of the nonwoven pad 30.

In use, one or more abrasive sheets 40 are engaged with the bottom surface 34 of the nonwoven pad 30 in a desired arrangement (see, e.g., FIGS. 3A–3F). The back connecting side 44 of the sheet 40 is urged against the bottom surface 34 of the nonwoven pad 30 to engage the hook stems 50 thereon with exposed fibers of the nonwoven pad 30. The abrasive article assembly thus defined is placed on a floor surface 16 to be treated, with the abrasive material 48 (on the front working side 46 of the sheet 40) and bottom surface 34 of the abrasive nonwoven pad 30 facing the floor surface 16. The abrasive article assembly is then aligned with and attached to the floor sander 10, or the floor sander 10 is simply aligned over the abrasive article assembly (as illustrated in FIG. 1), and then the motor of the sander 10 is activated. This rotates the drive platen 18 which in turn (via the rubber sheet 20) rotates the abrasive nonwoven pad 30 and abrasive sheet(s) 40 affixed thereto. The inventive abrasive article assembly thus presents an abrasive treatment to the floor surface 16 which has two different abrasive characteristics: (1) that provided by the abrasive material 48 on the sheet or sheets 40, and (2) that provided by the exposed abrasive portions of the nonwoven pad 30 between adjacent sheets 40.

This simultaneous presentation of two materials having different abrasive characteristics has proved particularly useful in the surface treatment of water-based floor coatings on wood flooring surfaces. When mounted on a rotary sander as described herein, the rotating abrasive nonwoven pad burnishes the coating on the floor surface while the abrasive on the abrasive sheet or sheets engaged thereto sands down the wood grains (wood ends, fibers or nibs) that were raised by application of the coating. The nonwoven pad also removes or decreases any scratches that may have been left by the abrasive sheet. The partial covering of the nonwoven pad with one or more abrasive sheets enhances the ability of the resultant abrasive article assembly to conform to an uneven floor surface without cutting too deeply. The present invention is useful for both solvent-based and water-based coatings. The abrasive assembly works well on any finish that may have dust or nibs caused by foreign contaminants or solid particles.

The use of the inventive abrasive article assembly allows for a wide range of abrasive presentation options using a single nonwoven pad. For instance, an abrasive sheet having aggressive abrasive characteristics can be used in connection with a nonwoven pad, and after use on a floor section, another abrasive sheet having a less aggressive abrasive grade can then be engaged with the nonwoven pad (instead of the original abrasive sheet) for further, finer floor surface conditioning. An endless variety of abrasive presentations can be configured, depending on the abrasive characteristics and abrasive grades of available abrasive nonwoven pads and abrasive sheets, and on the possible combinations thereof.

Figure 3A:
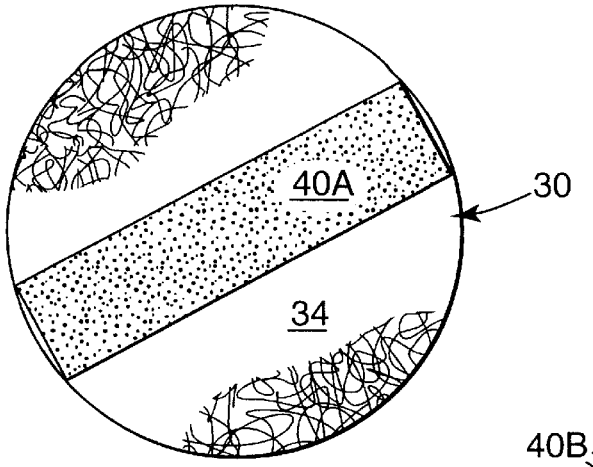
FIG. 3A is a bottom plan view of a first embodiment of the present invention.
Figure 3B:
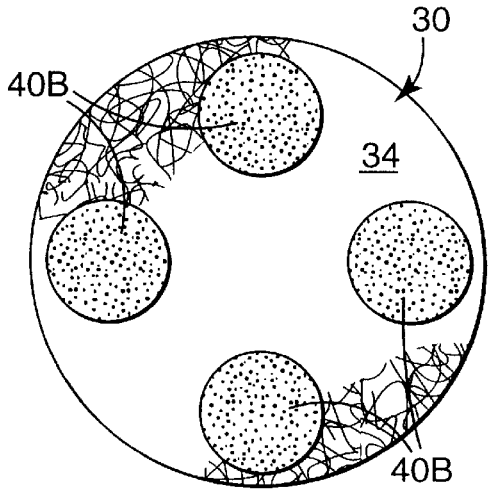
FIG. 3B is a bottom plan view of a second embodiment of the present invention.
Figure 3C:
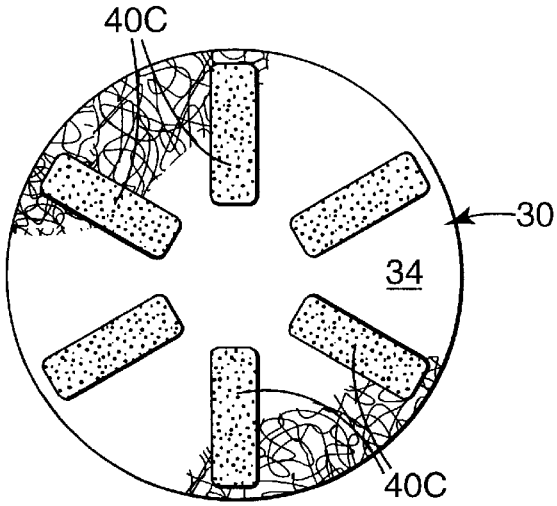
FIG. 3C is a third embodiment of the present invention.
Figure 3D:
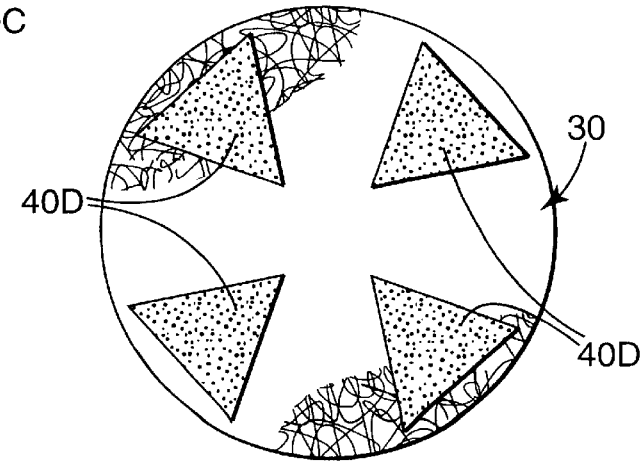
FIG. 3D is a fourth embodiment of the present invention.
Figure 3E:
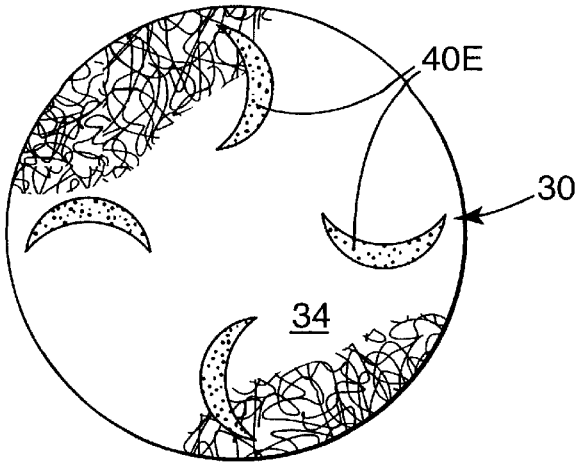
FIG. 3E is a fifth embodiment of the present invention.
Figure 3F:
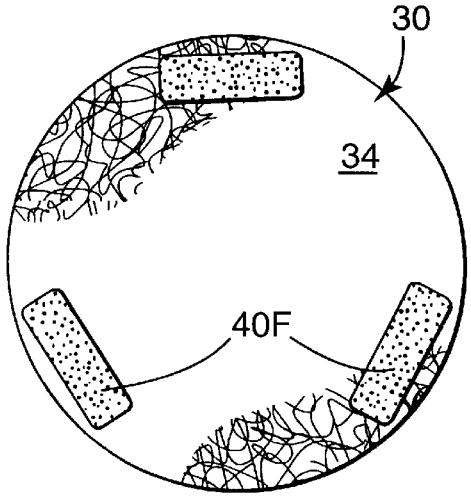
FIG. 3F is a sixth embodiment of the present invention.

The abrasive characteristics of the inventive abrasive assembly can also be manipulated by changing the number, size and layout of abrasive sheets on the nonwoven pad. FIGS. 3A–3F provide examples of alternative layouts for the abrasive sheets on an abrasive nonwoven pad. In FIG. 3A, a single abrasive sheet 40A is disposed and affixed across the bottom surface 34 of the abrasive nonwoven pad 30. In FIG. 3B. four circular abrasive sheets 40B are employed. In FIG. 3C, six generally rectangular abrasive strips 40C are employed. The generally rectangular strips 40C are aligned and elongated along radial lines extending out from the rotation axis of the nonwoven pad 30. Alternatively, elongated abrasive strips may be laid out on chords of a circular pad, or may be canted relative to radial lines to facilitate dust removal during pad rotation. In FIG. 3D, four triangular-shaped abrasive sheets 40D are employed. In FIG. 3E, four crescent-shaped abrasive sheets 40E are employed. In FIG. 3F, four generally rectangular strips 40F, similar to those of FIG. 3C, are arranged around the circumference.

Figure 4A:
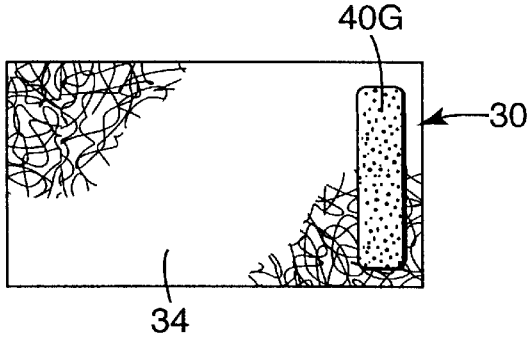
FIG. 4A is a seventh embodiment of the abrasive assembly of the present invention, illustrating its application in a rectangular format.
Figure 4B:
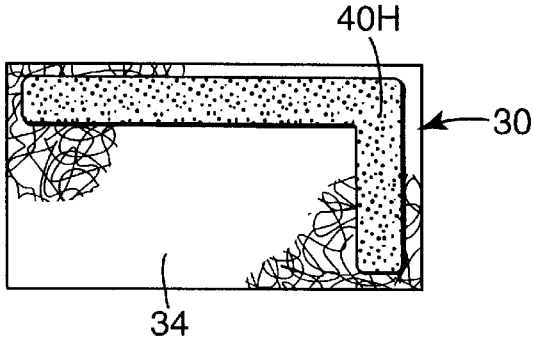
FIG. 4B is an eighth alternative embodiment of the present invention.

In each of these illustrated configurations, the several abrasive sheets may have identical abrasive grades, or the abrasive grades may differ (even among several sheets mounted on the same nonwoven pad) to achieve a desired surface treatment combination. These abrasive sheets may be symmetrical in shape (as generally illustrated), or may be asymmetrically shaped, and any number of sheets may be employed. Further, shapes and sizes may be mixed to attain desired surface treatment characteristics for the abrasive article assembly. One other example of an abrasive assembly is a circular nonwoven pad with an annular or "donut" shaped abrasive sheet. With a circular nonwoven pad, such as illustrated in FIGS. 3A–3F, it is preferable that multiple abrasive sheets be aligned on the nonwoven pad in a symmetrical manner. For noncircular pads, such as shown in FIGS. 4A–4B, the abrasive sheets 40G (FIG. 4A) and 40H (FIG. 4B) may be placed in a nonsymmetrical manner. In addition, alternatively shaped sheets (such as L-shaped sheet 40H in FIG. 4B) can be used.

Adhering the abrasive sheets 40 to the bottom surface 34 of the nonwoven pad 30 by means of hook stems 50 alone (as depicted in the embodiments of FIGS. 14) works well when sanding a smooth surface such as a floor. However, even when the abrasive sheets are affixed via the hook stems 50 to the nonwoven pad 30, it is possible for the sheets to become dislodged when the abrasive article assembly encounters a workpiece edge, such as a heater vent, floor edge, molding, raised board, etc. Further integration of the abrasive sheet and nonwoven pad components are shown in the abrasive article assembly embodiment illustrated in FIGS. 5–7. In this version of the present invention, the abrasive sheet is even more affirmatively engaged to the nonwoven pad, particularly along a leading working edge of the abrasive sheet, an arrangement which is particularly advantageous when the workpiece surface has an uneven face or includes edges (such as the side channel edges of a bowling lane).

Figure 7:
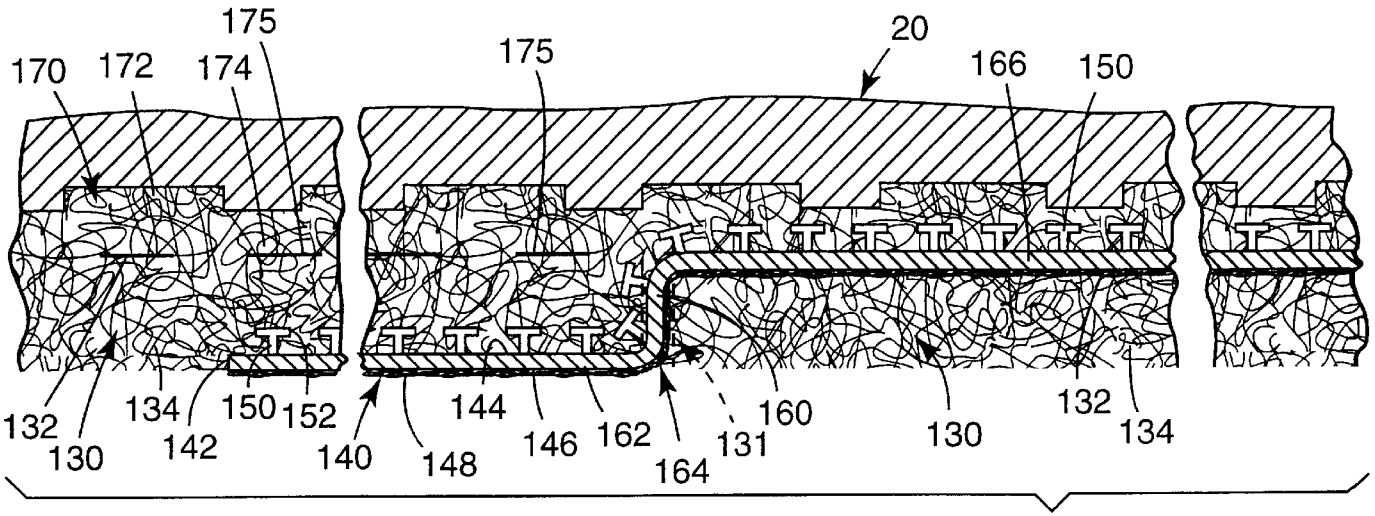
FIG. 7 is a sectional view as taken along lines 7—7 in FIG. 6.

As seen in FIGS. 5–7, a first circular nonwoven pad 130 has a top surface 132 and bottom surface 134. The nonwoven pad 130 is formed such as the nonwoven pad 30 described above, but additionally has one or more slits 131 therein (each slit extends at least partially through the pad thickness, or each slit extends completely through the pad, from its top surface 132 to its bottom surface 134). In FIG. 5, four slits 131 are illustrated. The slits 131 are preferably symmetrically disposed about a central axis 133 of the circular nonwoven pad 130. Further, each slit 131 is preferably aligned relative to a radial line (such as radial 135) extending outwardly from the axis 133 of the circular nonwoven pad 130 toward its circumference 137. Each slit 131 has an inner end 131*a* and an outer end 131*b*, with the outer end 131*b* of each slit spaced from the circumference 137 of the nonwoven pad 130, as seen in FIG. 6.

Each slit 133 is adapted to receive at least a portion of an abrasive sheet 140 therein. The abrasive sheet 140 is generally of the same structure as disclosed with respect to abrasive sheet 40 in FIGS. 1–4 above. Abrasive sheet 140 includes a substrate layer 142 having a first connecting side 144 and a second working side 146, with abrasive material 148 disposed over the second working side 146 of the substrate layer 142. A plurality of hook stems 150 are disposed on the first connecting side 144, with each hook stem 150 having an enlarged head 152.

As seen in FIG. 7, a first portion 160 of the abrasive sheet 140 is inserted into the slit 131 of the nonwoven pad 130. The first portion 160 may be inserted to the complete depth of the slit 131 (which may or may not be completely through the nonwoven pad 131) or may only be partially inserted therein. In either event, a second portion 162 of the abrasive sheet 140 is folded back from the first portion 160 (along bent edge 164 at slit 131) to have the hook stems 150 on its connecting side 144 engaged with the bottom surface 134 of the nonwoven pad 130. The abrasive sheet 140 is thereby affirmatively connected to the nonwoven pad 130 by means of the engaged hook stems 150 and fiber segments of the nonwoven pad 130, but also by having the first portion 160 of the abrasive sheet 140 inserted and retained in the slit 131 of the nonwoven pad 130 (the hook stems 150 on the connecting side 144 of the first portion 160 of the abrasive sheet 140 also engage and connect to the nonwoven pad 130).

When the slit 131 extends completely through the first nonwoven pad 130, a third portion 166 of the nonwoven pad preferably extends out of the slit 131 and is folded over against the top surface 132 of the first nonwoven pad 130. As seen in FIG. 7, the third portion is folded to the right of the slit 131 (or away from the second portion 162). The third portion 166 may be folded in either direction from the slit 131. However, when folded to the right as viewed in FIG. 7, the hook stems 150 on the connecting side 144 of the abrasive sheet 140 then extend outwardly from the abrasive article assembly formed by the abrasive sheet 140 and first nonwoven pad 130, along the top surface 132 of the first nonwoven pad 130. This is particularly useful when a second circular nonwoven pad 170 is provided as a cushioning pad between the rubber sheet 20 of the sander and the first circular nonwoven pad 130.

The second nonwoven pad 170 is formed and configured generally the same as the first nonwoven pad, and may or may not include one or more slits 131. The second nonwoven pad 170 has a top surface 172 and a bottom surface 174, as seen in FIG. 7. When aligned between the rubber sheet 20 and the first nonwoven pad 130, the second nonwoven pad 170 acts as a cushion or buffer between those components. For clarity, the separation of the first and second nonwoven pads 130 and 170 is illustrated by dashed line 175 in FIG. 7. The hook stems 150 on the third portion 166 of the abrasive sheet 140 are thus exposed to the fiber segments on the bottom surface 174 of the second nonwoven pad 170. This not only engages the abrasive sheet 140 to the second nonwoven pad 170, but also serves to secure the first nonwoven pad 130 (which itself is secured to the abrasive sheet 140) to the second nonwoven pad 170.

In use for abrading a workpiece, the abrasive article assembly is rotated in direction of arrows 180 (FIG. 5 is a view from the bottom of the abrasive article assembly). Thus, the bent edge 164 serves as the leading edge for the abrasive sheet 140 as it moves across the workpiece surface. This leading edge 164 is much less apt to tear or become dislodged from the nonwoven pad 130 than if it were not folded into the slit 131. Thus, a more durable abrasive article assembly is presented to a roughened workpiece surface, or a workpiece surface having edges.

In the embodiment illustrated, the abrasive sheet 140 is generally rectangular, and has parallel side edges. Its leading edge (defined by bent edge 164) is spaced from its trailing edge 182 (see FIG. 6). The generally rectangular abrasive sheet 140 is inserted at an angle relative to the slit 131 (along a chord relative to radial 135), so that its trailing edge 182 is closer to the circumference 137 of the nonwoven pad 130 than the leading edge 164. As such, the trailing edge 182 and leading edge 164 are not parallel. This allows the presentation of the second portion 162 of the abrasive sheet 140 (its working portion) to be closer to the circumference 137 than the farthermost extent of the slit 131 (outer end 131*b*). The fact that the slit 131 does not extend entirely to the circumference 137 allows for greater integrity of the nonwoven pad 130. This angled alignment of the abrasive sheet 140 relative to the radial 135 and slit 131) also serves to help move grinding swarf to the outside of the nonwoven pad 130 during use, rather than allowing such excess debris to build up within the nonwoven pad 130.

In use, the abrasive article assembly illustrated in FIGS. 5–7 sequentially presents a workpiece with the bottom surface 134 of the nonwoven pad 130 and the abrasive material 148 on the working side 146 of the second portion 162 of the abrasive sheet 140. During use, one or more of these components may become worn, diminishing its desired abrasive characteristics. In that instance, the abrasive sheets 140 or nonwoven pad 130 may be replaced, either individually or collectively.

Figure 8:
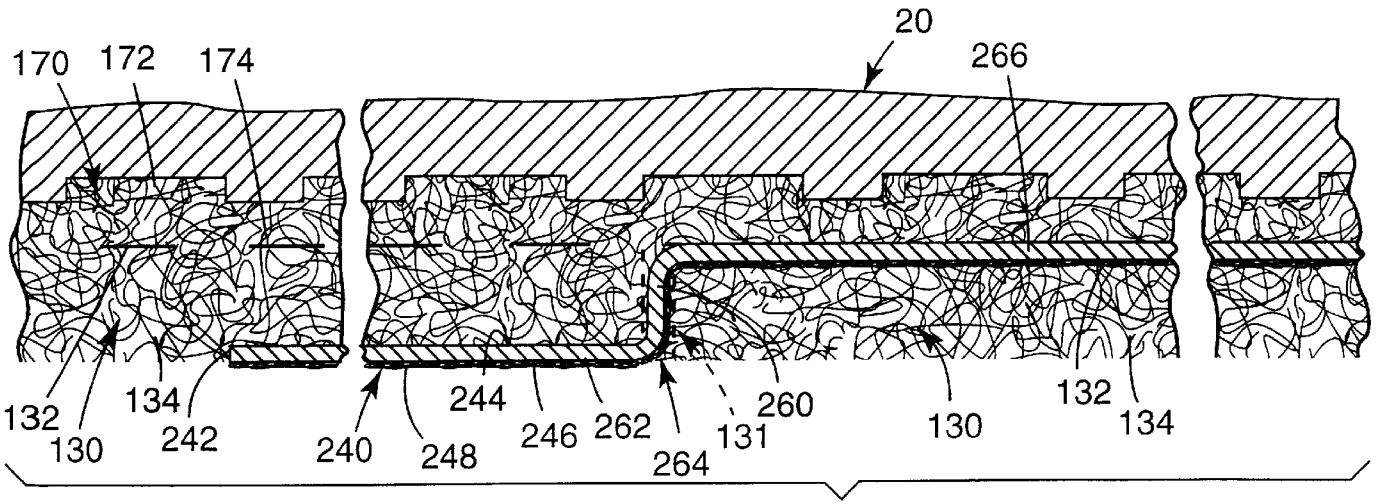
FIG. 8 is a sectional view similar to that of FIG. 7, but showing a tenth alternative embodiment of the present invention.

FIG. 8 illustrates another embodiment of the abrasive article assembly of the present invention. In this embodiment, the first circular nonwoven pad 130 is again provided with one or more slits 131. In fact, all components of the abrasive article assembly are the same as those illustrated in FIGS. 5–7 except for the abrasive sheet. As shows in FIG. 8, an abrasive sheet 240 has a substrate layer 242 which has a first side 244 and a second working side 246. In this embodiment, there are no hook stems on the first side 244 of the abrasive sheet 240.

A first portion 260 of the abrasive sheet 240 is inserted partly or entirely into the slit 131 in the first nonwoven pad 130. A second portion 262 of the abrasive sheet 240 is folded back (at bent edge 264) so that the second working side (bearing abrasive material 248) is exposed along with the bottom surface 134 of the first nonwoven pad 130. When the slit 131 extends completely through the nonwoven pad 130, a third portion 266 of the abrasive sheet is folded to lie between the first and second nonwoven pads 130 and 170 (in either direction, to the left or right as viewed in FIG. 8).

The engagement of the abrasive sheet 240 and the slit 131 is sufficient to retain the abrasive sheet 240 in place during use of the abrasive article assembly. Even though a rough surface or edges are encountered by its leading edge 264, the abrasive sheet 240 stays in the slit 131 during use. Hook stems on the first side 244 of the abrasive sheet 240 (or some other engagement means) are not necessary to retain the abrasive sheet 240 generally in place on the nonwoven pad. However, to even more affirmatively secure the components together, the first side 244 of the abrasive sheet 240 may include an exposed pressure sensitive adhesive, headless stems, or some other engagement structure, such as a coating of abrasive material of the same or a different grade than the abrasive material 248 on the second working side 246 thereof.

In a preferred embodiment, the nonwoven pad 130 is 16 inches in diameter, and approximately 5/16 inches thick. As seen in FIG. 5, nonwoven pad 130 preferably has a 7/8 inch diameter center hole 185, which has four short slits 186 radiating outwardly therefrom about ½ inch, 90° apart. In a preferred embodiment, an annular series of slits 187 serve to allow ready separation of the nonwoven pad 130 into two pads, a smaller diameter circular pad 188 for use on a rotary finishing device and a larger diameter ring-shaped pad 189 which bears the abrasive sheets 140.

While the disclosure herein is presented with respect to floor sanding and circular nonwoven pad configurations, the use of the present invention for other nonwoven pad configurations and other surface treatment applications is contemplated. Nonwoven pads of rectangular, square or other shapes can be used, along with other combinations of shapes, sizes and layouts (symmetrical or nonsymmetrical) of abrasive sheets, so long as the abrasive on the abrasive sheet is accompanied by some exposed portion of the nonwoven pad to provide a second abrasive characteristic surface in combination with the abrasive characteristics of the abrasive sheet engaged thereto. Further, in an embodiment of the invention which includes slits in the nonwoven pad, the slits may be of any desired orientation, size and number, depending in part on the shape of the pad and operator preference. In addition, the use of the abrasive article assembly of the present invention is not limited to rotary floor sander machines. The invention is useful for manual surface treatment techniques (e.g., a palm sander), as well as, for example, surface treatment operations using vibratory, orbital or industrial surface treatment apparatus. Examples of workpieces that might be so treated include furniture, cabinets, wood trim, automobile bodies and drywall. As such, the workpiece may be horizontally orientated (such as a floor) or vertically oriented (such as a table leg). Further, the workpiece surface may be generally flat (i.e., planar) or may be curved or otherwise irregular.

Although the present invention has been described with reference to preferred embodiments, workers skilled in the art will recognize that changes may be made in form and detail without departing from the spirit and scope of the invention.

What is claimed is:

1. An abrasive article for surface treatment of a workpiece comprises:

a nonwoven pad having front and back generally planar major faces, the pad having a slit in its front face; and a sheet having front and back major sides, the front side of the sheet defining a desired abrasive surface, the sheet having a first portion thereof extending into the slit in the nonwoven pad and a second operable portion thereof lying with its back side against the front face of the nonwoven pad, and the second operable portion being smaller than the front face of the nonwoven pad.

2. The abrasive assembly of claim 1 wherein the nonwoven pad has a plurality of said slits, and further comprising:

a plurality of said sheets, the first portion of each sheet extending into a respective one of the slits in the nonwoven pad and the second operable portion of each sheet lying with its back side against the front face of the nonwoven pad.

3. The abrasive assembly of claim 2 wherein the front face of the nonwoven pad is circular, and the slits are disposed on radial lines about the front face of the nonwoven pad.

4. The abrasive assembly of claim 2 wherein the second portion of each sheet is spaced closer to the outer circumference of the planar face of the nonwoven pad than the first portion of the sheet.

5. The abrasive assembly of claim 2 wherein the front face of the nonwoven pad is circular, each slit has an inner end and an outer end, and the outer end of each slit is spaced from an outer circumference of the circular front face of the nonwoven pad.

6. The abrasive assembly of claim 2 wherein the front face of the nonwoven pad is circular, and the sheets are symmetrically disposed about the front face of the nonwoven pad.

7. The abrasive assembly of claim 4 wherein the sheets are identically shaped.

8. The abrasive assembly of claim 1 wherein the slit extends completely through the nonwoven pad.

9. The abrasive assembly of claim 8 wherein the nonwoven pad is a first nonwoven pad, and further comprising:

a second nonwoven pad having front and back major faces, the front face of the second nonwoven pad aligned to overlie the back face of the first nonwoven pad; and a third portion of the sheet extending out of the slit on the back face of the first nonwoven pad and lying between adjacent portions of the first and second nonwoven pads.

10. The abrasive assembly of claim 9 wherein the first nonwoven pad has a plurality of said slits therethrough, and further comprising:

a plurality of said sheets, the first portion of each sheet extending into a respective one of the slits in the first nonwoven pad, the second operable portion of each sheet lying with its back side against the front face of the first nonwoven pad and the third portion of each sheet extending out of the slit on the back face of the first nonwoven pad and lying between the first and second nonwoven pads, with the back side of the third portion of each sheet lying against the front face of the second nonwoven pad.

11. The abrasive assembly of claim 10 wherein each sheet has means for engaging those portions of the first and second nonwoven pads in engagement with the back side of the sheet.

* * * * *

UNITED STATES PATENT AND TRADEMARK OFFICE

CERTIFICATE OF CORRECTION

PATENT NO. : 6,261,164 B1
DATED : July 17, 2001
INVENTOR(S) : Allen J. Rivard, Galen A. Fitzlel and Chris A. Minick It is certified that error appears in the above-identified patent and that said Letters Patent is hereby corrected as shown below:

Column 7,
Line 63, "FIGS 14" should read -- FIGS 1-4 --

Column 9,
Line 66, "shows" should read -- shown --

Signed and Sealed this

Thirtieth Day of April, 2002

*Attest:*

*Attesting Officer*

JAMES E. ROGAN
*Director of the United States Patent and Trademark Office*